US006494179B1

(12) United States Patent
Pantring et al.

(10) Patent No.: US 6,494,179 B1
(45) Date of Patent: Dec. 17, 2002

(54) METHOD AND DEVICE FOR OPERATING AN INTERNAL COMBUSTION ENGINE WITH DIRECT GAS INJECTION

(75) Inventors: Juergen Pantring, Schwieberdingen (DE); Werner Hess, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/914,761

(22) PCT Filed: Oct. 21, 1999

(86) PCT No.: PCT/DE99/03373

§ 371 (c)(1),
(2), (4) Date: Sep. 18, 2001

(87) PCT Pub. No.: WO00/52318

PCT Pub. Date: Sep. 8, 2000

(30) Foreign Application Priority Data

Mar. 5, 1999 (DE) ..... 199 09 658

(51) Int. Cl.[7] ..... F02B 17/00
(52) U.S. Cl. ..... 123/295; 123/305
(58) Field of Search ..... 123/305, 295, 123/294, 299, 319

(56) References Cited

U.S. PATENT DOCUMENTS

| | | | | |
|---|---|---|---|---|
| 5,483,934 A | | 1/1996 | Stutzenberger | |
| 5,806,496 A | | 9/1998 | Saito | |
| 5,826,565 A | | 10/1998 | Mueller et al. | |
| 5,881,693 A | * | 3/1999 | Mizuno | 123/295 |
| 6,026,779 A | * | 2/2000 | Obata et al. | 123/295 |
| 6,390,054 B1 | * | 5/2002 | Yang | 123/295 |

FOREIGN PATENT DOCUMENTS

| | | |
|---|---|---|
| EP | 0 838 582 | 4/1998 |
| EP | 0 962 647 | 12/1999 |

* cited by examiner

*Primary Examiner*—Bibhu Mohanty
(74) *Attorney, Agent, or Firm*—Walter Ottesen

(57) ABSTRACT

A method and an arrangement for operating an internal combustion engine having gasoline direct injection is suggested which includes at least two cylinder banks or cylinder groups. The internal combustion engine is controlled on the basis of at least one input value. In at least one operating state, the input value for one cylinder bank or cylinder group differs from the input value for at least a second cylinder bank or cylinder group.

10 Claims, 3 Drawing Sheets

METHOD AND DEVICE FOR OPERATING AN INTERNAL COMBUSTION ENGINE WITH DIRECT GAS INJECTION

FIELD OF THE INVENTION

The invention relates to a method and an arrangement for operating an internal combustion engine having gasoline direct injection.

BACKGROUND OF THE INVENTION

A method and an arrangement for operating an internal combustion engine with gasoline direct injection are described in DE 43 32 171 A1 (U.S. Pat. No. 5,483,934). In the control system disclosed there, the entire operating range of the engine is subdivided into various regions in accordance with rpm and load and, depending upon the actual operating region, the fuel is either injected during the induction stroke or during the compression stroke. With an injection during the induction stroke, a substantially homogeneous fuel distribution (homogeneous operation) results because of the time available until ignition as well as because of the swirling of the injected fuel by the inducted air flow; whereas, a stratified charge (stratified operation) arises in the case of injection during the compression stroke. In the homogeneous operation, the engine is operated throttled, that is, the air supply is limited by a throttle flap. In the stratified charge operation, the engine is operated virtually unthrottled, that is, the air supply through the throttle flap is virtually not limited. A switchover between these operating modes takes place in dependence upon the above-mentioned operating variables and/or on other predetermined criteria, for example, with respect to the power demands made by the driver.

SUMMARY OF THE INVENTION

It is an object of the invention to further optimize the operation of an internal combustion engine having gasoline direct injection.

This is achieved with the characterizing features of the independent patent claims.

With the state of the art mentioned initially herein, a switchover is always made for the entire engine between the individual operating modes thereof. Furthermore, all cylinders contribute uniformly to the torque of the engine. In this way, flexibility and degrees of freedom in the configuration of the control are surrendered.

A further optimization of the drive of a motor vehicle is achieved with an asymmetric operation of an internal combustion engine having gasoline direct injection, especially when the engine has at least two cylinder banks which can be controlled independently of each other.

It is of special advantage that, in operating states in which the power, which is wanted by the driver, can no longer be made available because of the low consumption stratified charge operation, only a part of the engine, for example, one cylinder bank is driven in the comparatively consumption-intensive homogeneous operation. The other cylinder bank continues to be operated with the low consumption stratified charge operating mode. In this way, on the one hand, the increased power demands of the driver can be made available while, on the other hand, the consumption is minimized. This advantage is also achieved in that the contribution of individual cylinder banks or cylinder groups to the total torque is pregiven differently.

A further advantage, which is achieved by such an asymmetric operation of the engine, is an improvement of the noise emission or generally of the comfort of the engine. It is especially advantageous in this context that, when clearing a storage catalytic converter in idle or in the part-load region, not all banks are switched over simultaneously. The noise emission is optimized by the alternating switchover.

Of special significance is further that more degrees of freedom in the configuration of the exhaust-gas concepts are available because of the asymmetric operation of the engine having gasoline direct injection. For example, the power request of the driver is converted in such a manner that one part of the engine is operated in an exhaust-gas optimal operating mode and at an exhaust-gas optimal operating point; whereas, the actual power demand of the driver is executed by the control of the operating point as well as, if required, the operating mode of another part of the engine.

Of special advantage is the application of the asymmetric operation in an internal combustion engine having gasoline direction injection with at least two cylinder banks having at least two throttle flaps controllable independently of each other. In an advantageous manner, this idea can also be applied in engines having only one throttle flap. The air charge is adjusted in such a manner that one portion of the cylinders is operated homogeneously and the other portion is operated in a stratified operating mode. The latter leads to a total increased air charge so that the throttle losses are reduced compared to a homogeneous operation of the entire engine.

In addition to the switchover between the operating modes with stratified charge and with homogeneous fuel mixture formation, the principle of the asymmetric operation of the engine is also applied between operating modes such as homogeneous stoichiometric, homogeneous lean or mixed operating modes such as an operating mode having double injection wherein a homogeneous fuel mixture arises as well as a stratified fuel mixture. Here too, the advantages which are achieved via the asymmetric operation are arrived at as described above.

BRIEF DESCRIPTION OF THE DRAWINGS

Drawing

The invention will be explained in greater detail in the following with reference to the embodiments shown in the drawing.

DESCRIPTION OF THE PREFERRED EMBODIMENT OF THE INVENTION

Figure 1:
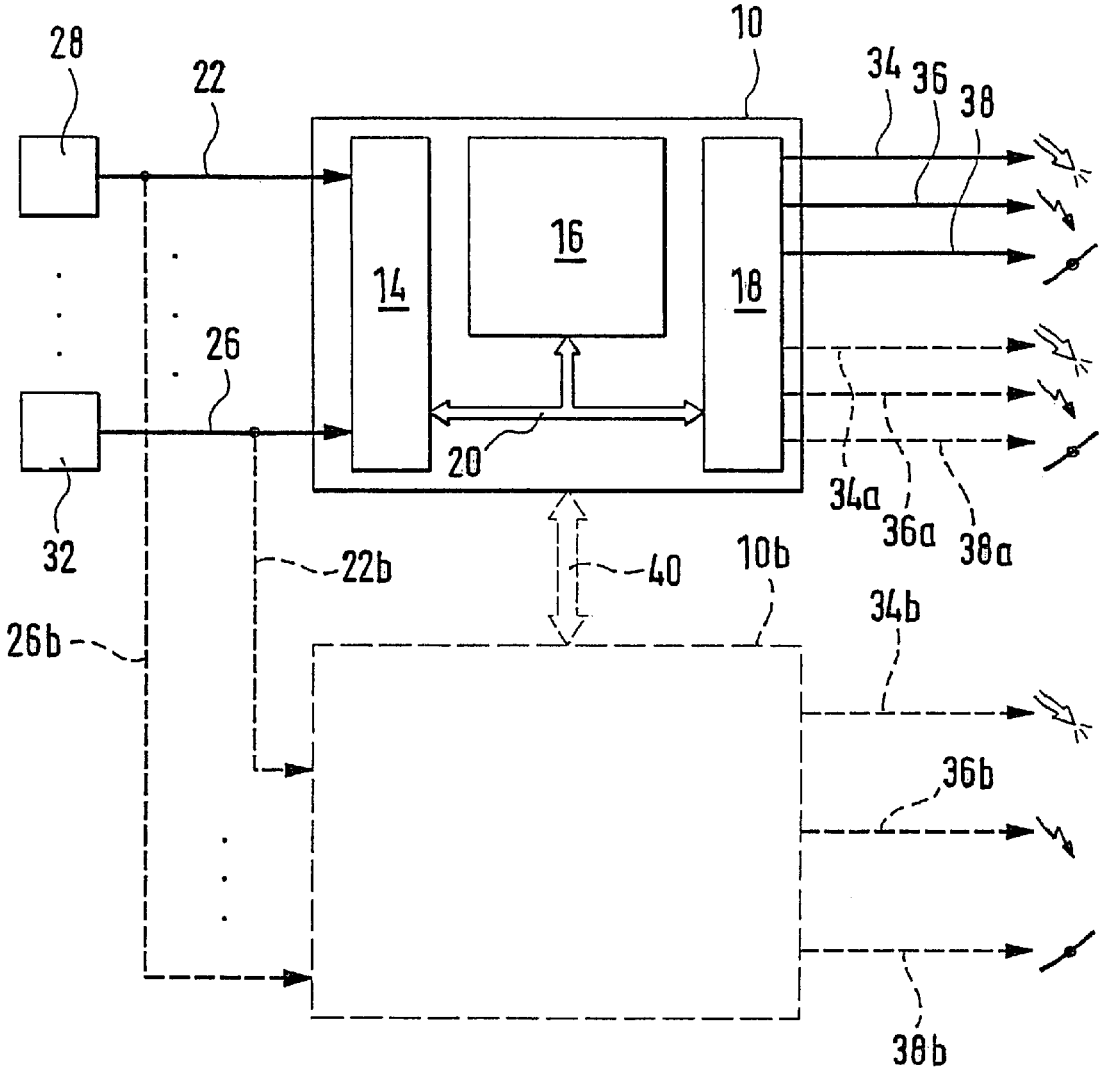
FIG. 1 shows an overview circuit diagram of a control arrangement for controlling an internal combustion engine having gasoline direct injection.

FIG. 1 shows a block circuit diagram of a control arrangement for controlling an internal combustion engine having gasoline direct injection. A control apparatus 10 is provided which includes the following components: an input circuit 14, at least one microcomputer 16 and an output circuit 18. A communications system 20 connects these components for mutual data exchange. Input lines 22 to 26 lead to the input circuit 14 of the control apparatus 10 and these lines are configured as a bus system in a preferred embodiment. Signals are supplied to the control apparatus 10 via the input lines 22 to 26 which represent operating variables to be evaluated for the control of the internal combustion engine. These signals are detected by measuring devices 28 to 32. Operating variables of this kind are: accelerator pedal position, engine rpm, engine load (for example, air mass), exhaust-gas composition, engine temperature, et cetera. The control apparatus 10 controls the power of the engine having direct gasoline injection via the output circuit 18. This is symbolized in FIG. 1 with output lines 34, 36 and 38 which actuate at least the fuel mass to be injected, the ignition angle of the engine as well as at least one electrically actuable throttle flap for adjusting the air supply to the engine. The illustration selected in FIG. 1 means that the injection valves of a specific number of cylinders of the engine are actuated via the symbolic output line 34, that is, the fuel mass, which is to be injected, is supplied to these cylinders. The ignition spark in these cylinders is triggered at a predetermined time point via the output line 36 and an electrically actuable throttle flap is controlled which influences the air supply to these cylinders.

In internal combustion engines having at least two cylinder banks or cylinder groups wherein the air is supplied to each cylinder bank via an electrically controllable throttle flap, there are essentially two embodiments provided which are represented in phantom outline in FIG. 1. On the one hand, the second cylinder bank (at least the fuel mass to be injected, the ignition angle and the air supply) is controlled by the control apparatus 10 in the same manner as the first cylinder bank via the output circuit 18 as well as output lines 34*a*, 36*a* and 38*a* which correspond to output lines 34, 36 and 38. This means that one control apparatus controls at least two cylinder banks. In another embodiment, in lieu of lines 3*a* to 38*a*, a second control apparatus 10b is provided which is built up in the same manner as control apparatus 10 and which adjusts fuel mass, ignition angle and air supply of at least one further cylinder bank via the output lines 34*b*, 36*b* and 38*b*. The two control apparatus 10 and 10*b* are connected to each other via a communications system 40 which connects the same for mutual data exchange. Via this communications system and dependent upon the embodiment, at least one of the control units is supplied with individual or all of the operating variable signals detected by the other control unit or the operating variables derived from these operating variable signals for further evaluation. In another embodiment, input lines 22*b* to 26*b* are also supplied to the control apparatus 10*b* in addition to the control apparatus 10 so that the operating variable signals are directly present at the control apparatus 10*b* alternatively to transmission via the communication system or in addition thereto.

Figure 2:
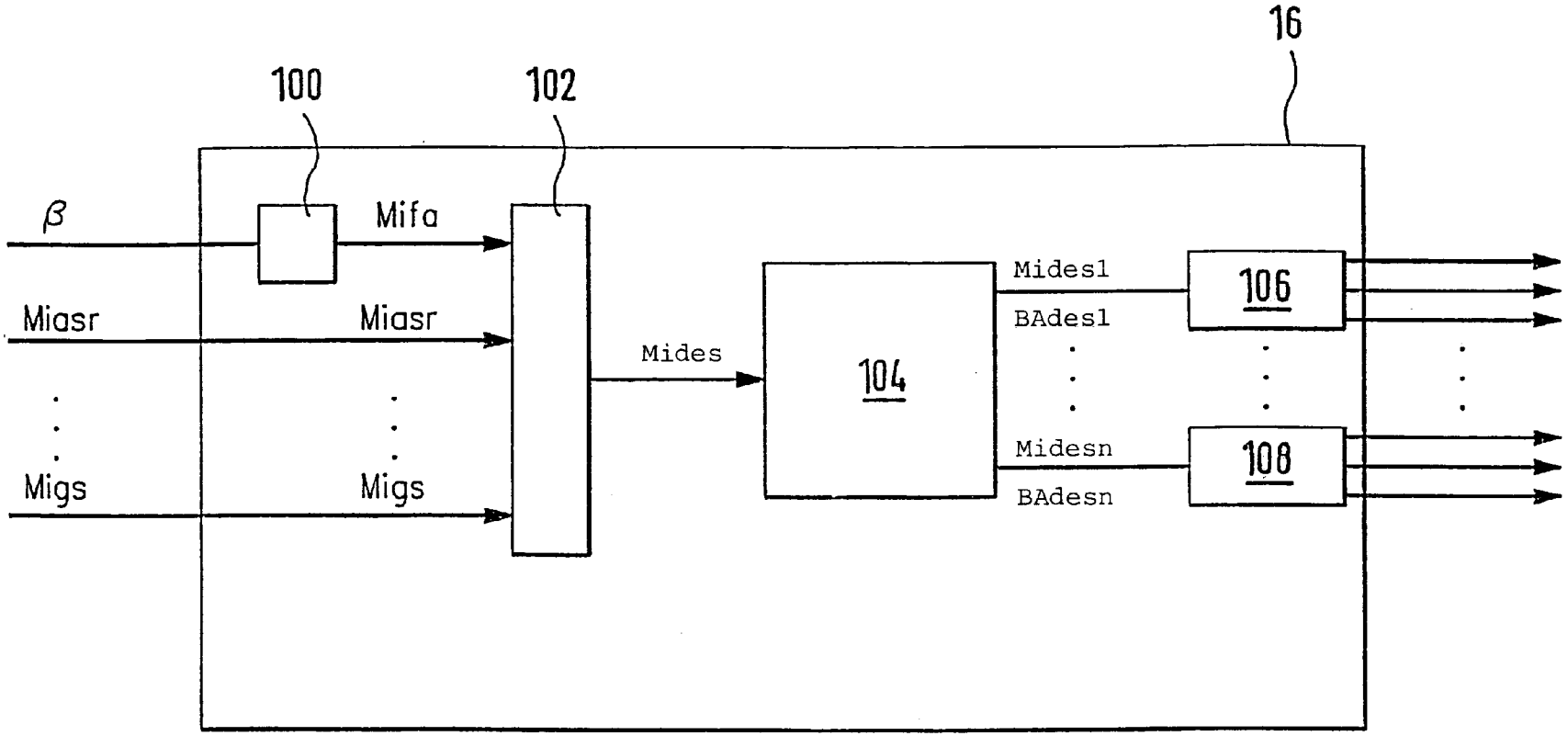
FIG. 2 shows a sequence diagram with reference to an embodiment and this sequence diagram shows the principle of the asymmetric operation of such an internal combustion engine; and, FIG. 3 shows a further embodiment which sketches a preferred configuration as a flowchart.

The basic procedure for the control of the engine, which runs in the microcomputer 16 of the control apparatus 10, is sketched in the sequence diagram of FIG. 2. As essential operating variables, the accelerator pedal position β as well as operating variables such as engine rpm NMOT, air mass MHFM and desired torques of other control systems (for example, from a drive slip control and/or a transmission control) are supplied to the microcomputer 16. In the driver command former 100, a driver command torque MIFA of the engine is determined from the supplied accelerator pedal position signal β at least while considering the engine rpm and, if required, a corrective quantity of an idle rpm control, et cetera. This takes place in a preferred embodiment by means of a characteristic field and subsequent computation steps. Furthermore, the following are supplied to the microcomputer 10: desired torques of other control systems, for example, a desired torque MIASR of a drive slip control, a desired torque of a transmission control MIGS, et cetera. These desired torques and the driver command torque are supplied to a selection stage 102 wherein a resulting desired torque MIDES for the control of the engine is determined from the supplied desired torques. In the preferred embodiment, the selection takes place via minimum and/or maximum selection. The resulting desired torque MIDES, which is determined in this way, is supplied to a further coordinator 104 wherein the inputs for an asymmetrical operation of the engine are determined. These inputs are described below with respect to the flowchart of FIG. 3. The coordinator 104 converts the total desired torque MIDES into individual desired torques MIDES1 to MIDESN for the individual cylinder banks or for individual cylinder groups and/or converts the total desired torque MIDES into desired operating modes BADES1 to BADESN of the individual cylinder banks or cylinder groups. The subdivision of the desired torque as well as the input of desired operating modes takes place in accordance with pregiven strategies via the coordinator 104.

In normal operation at lower and average loads, all cylinder banks or all cylinder groups are operated in stratified charge operation because of reasons of consumption. In the normal case, the desired torques are uniformly distributed to the individual banks. If an increased power request on the engine is detected from the desired torque MIDES (which power request cannot only be made available by a stratified operation of all cylinder banks), the desired torque for one of the cylinder banks or cylinder groups is increased, whereupon, if required, this cylinder bank or cylinder group changes the operating mode or adjusts their desired operating mode to homogeneous operation. In this way, an optimization of consumption is achieved in comparison to a complete switchover because the other cylinder banks or cylinder groups are still operated in the consumption-optimal lean stratified charge operation. The corresponding applies to the other operating modes, for example, a lean operation having homogeneous mixture formation or mixed operating types having double injection wherein homogeneous as well as also stratified fuel mixture formation takes place. Here too, when an increased power request is present, individual cylinder banks or cylinder groups are operated in consumption-optimal operation as far as possible and another bank or group is switched over into a power-optimized operating mode to make available the torque.

Another strategy, which is implemented in the coordinator 104 in one embodiment, is a comfort optimization according to which the switchover of individual cylinder banks or cylinder groups from one operating mode into the other operating mode never takes place simultaneously but is pregiven sequentially. In this way, the noise emission is reduced which is associated with the switchover.

Especially in storage catalytic converters, a switchover must be made from time to time from stratified charge operation into the operation with homogeneous mixture formation in order to clear the catalytic converter. In this connection also, the illustrated procedure of the asymmetric operation of the engine can be used successfully because, at least in idle and in the part-load range, both banks need not be switched over simultaneously in order to clear the catalytic converter but can be switched over sequentially or, for only one catalytic converter for all banks or cylinder groups, only the alternate switchover of one cylinder bank or cylinder group is sufficient. In this way, a considerable comfort improvement is achieved, especially a reduction of noise emission.

In an especially advantageous manner, an exhaust-gas optimal strategy (for example, in the region of low power requests) can be utilized in addition to a consumption-optimal and a comfort-optimal strategy. Here, the allocation of the torques and/or the input of the desired operating mode takes place in such a manner that a lowest possible exhaust gas burden occurs. It is therefore attempted, for example, to make available the total desired torque by means of lean operation in stratified operation and/or homogeneous operation as long as this torque can be adjusted with the particular operating mode. Only then, a less exhaust-gas optimal operating point is adjusted for a cylinder bank or cylinder group by inputting a deviating desired torque and/or a wanted operating mode.

The individual desired torques MIDES1 to MIDESN as well as the corresponding wanted operating mode are supplied to the respective control signal formers 106 to 108 for the individual cylinder banks or cylinder groups. In each of these control signal formers 106 to 108, the particular desired torque is converted into a fuel mass, which is to be injected, an ignition angle and a throttle flap position while considering the desired operating mode. This conversion of the particular desired torque takes place while considering operating variables such as engine rpm, relative air mass (derived from the supplied air mass), et cetera. Here, it can happen that the wanted operating mode cannot be realized, for example, when: an emergency situation is present, when the desired torque cannot be adjusted, for special operating functions such as start, warm running, heating of the catalytic converter, et cetera.

A system is shown in FIG. 2 wherein, for each cylinder bank or cylinder group, its own throttle flap can be driven. In this case, the operating mode for each bank can be freely selected and the torque requests are so distributed to the banks that an optimal efficiency of the engine results, that is, depending upon the strategy, an optimal operation of the engine results. If the engine has only one throttle flap, then this flap is to be adjusted in such a manner that an air charge results which permits, via an appropriate computation of the fuel mass, to operate one cylinder bank homogeneously and another cylinder bank stratified. In this way, an air charge is adjusted, which is overall increased compared to the homogeneous operation of the engine, whereby throttle losses are reduced. A rapid change of the operating mode of the cylinder banks is here possible via a control of the fuel mass.

Figure 3:
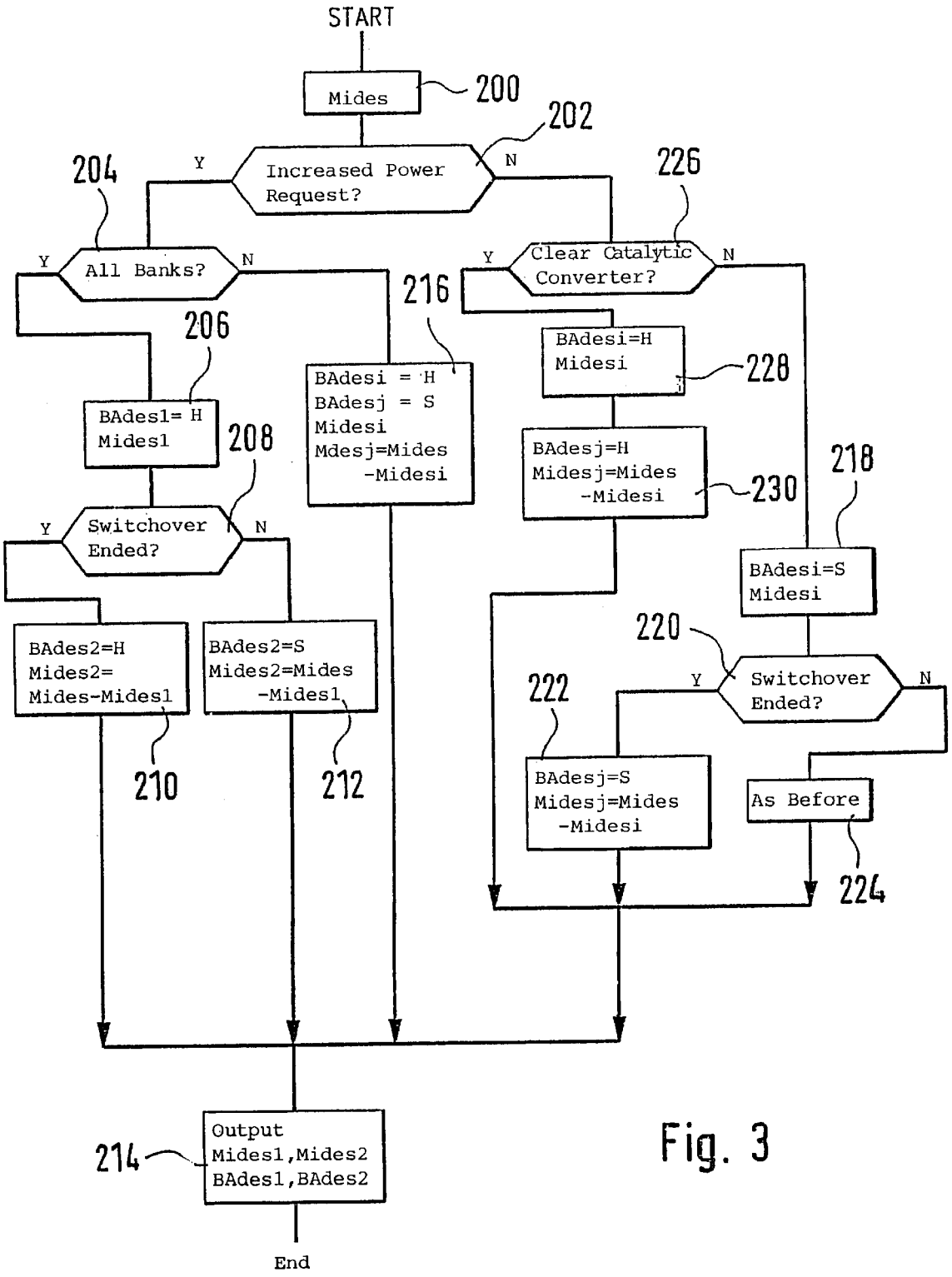

An embodiment of the coordinator 104 is outlined in greater detail with respect to the flowchart of FIG. 3 for an example of an engine having two independently controllable cylinder banks or cylinder groups. The program is run through at pregiven time intervals.

In the first program step 200, the total desired torque MIDES is detected. In the next step 202, a check is made on the basis of this desired torque as to whether an increased power request is present. In a preferred embodiment, this is then the case when the desired torque exceeds a pregiven limit value. This threshold value is so dimensioned that it corresponds approximately to a boundary line above which the engine would operate with homogeneous mixture formation because of power reasons. If, in step 202, an increased power request was detected, then a check is made in step 204 as to whether the power request is so high that all cylinder banks or cylinder groups have to be switched over. This is the case when a desired torque value is requested which lies in the proximity of the maximum value. If this is the case, then, in accordance with step 206, the homogeneous operation is outputted as a wanted operating mode of the first bank group or the cylinder group BADES1 and a desired torque value MIDES1 is determined for this cylinder bank or cylinder group. This desired torque value is formed in a preferred embodiment on the basis of the total desired torque value which is read-in in step 200. Especially, a percentage of this desired torque value >50% is pregiven. Thereafter, in step 208, a check is made as required on the basis of a transmitted mark as to whether the switchover is ended. If this is the case, then, according to step 210, the homogeneous operation is outputted also for the second cylinder bank or second cylinder group as a desired operating mode and the desired torque of this cylinder bank or cylinder group is determined on the basis of the total desired torque and of the desired torque of the first cylinder bank or first cylinder group. If the switchover of the first cylinder bank in accordance with step 208 has not yet ended, then, in accordance with step 202, the desired operating mode of the second cylinder bank is maintained at stratified charge operation and, as desired torque value in correspondence to step 210, the difference between the total desired torque value and the desired torque value of the first bank is determined. After steps 210 and 212, the formed desired values are outputted in step 214 and, when no higher-order inputs are present, the desired values are realized. The higher order inputs can, for example, include emergency operation, absent realizability of the desired torque value in the desired operating mode, et cetera. Thereafter, the subprogram is ended and is run through again at the next time interval.

If, in accordance with step 204, a power request is detected, which does not require a switchover of all banks, then, in accordance with step 216, the desired operating mode of one bank is set to the homogeneous operation and the desired operating mode of the other bank is set to the stratified charge operation. In a like manner, the desired torque of the one bank, which is to be operated homogeneously, is formed analog to step 206 whereas the desired torque of the other bank, which is operated in the stratified charge operation, is determined on the basis of the total desired torque and of the desired torque of the first bank. Step 214 follows thereafter. With the asymmetric type of operation of the engine described in step 216, a consumption optimal control of the engine at increased power requests is obtained because a part of the engine continues to be operated in the consumption favorable stratified charge operation. Likewise, a comfort improvement is achieved because the banks or groups are not switched over simultaneously. The above-mentioned strategies to which the switchover to the catalytic converter clearing, which is to be explained hereinafter, and an exhaust-gas optimal control also belong, are applied depending upon configuration all together or in any desired combination, even individually.

If no increased power request is present in accordance with step 202, then a check is made in step 226 as to whether the conditions for clearing a storage catalytic converter are present. If the conditions for clearing are satisfied, then, in accordance with step 228, the homogeneous operation is outputted for one cylinder bank as a desired operating mode and a corresponding desired value (for example, the lowest desired torque for this operating mode) is determined. In the next following step 230, the stratified charge operation continues to be outputted as desired operating mode of the other bank and the desired torque is determined on the basis of the total desired torque and of the desired torque of the first bank. Step 214 follows thereafter. With this measure, a clearing of the storage catalytic converter is achieved without the entire engine being switched over into the homogeneous operation. In this way, in addition to consumption improvements, also noise and therefore comfort improvements are achieved.

If the conditions for clearing the catalytic converter are not present, then, in accordance with step 218, the desired operating mode of the first bank is set to the stratified charge operation and a corresponding desired torque, which is determined from the desired torque value, is outputted. In a preferred embodiment, this corresponds to 50% of the total desired torque value read-in in step 200. In the next-following step 220, a check is made as to whether, if required, the switchover from the stratified operation into the homogeneous operation is ended. If this is the case, then, in accordance with step 222, the second cylinder bank is also set to the desired operating mode "stratified charge" and the corresponding desired value is formed on the basis of the total desired torque value and the desired torque value of the first bank. If the switchover in accordance with step 220 is not ended, that is, if the system is in non-steady state operation, the second bank is controlled as previously in accordance with step 224 and the desired torque value is formed analog to step 222. With this measure, a simultaneous switchover of both banks and a loss of comfort in this way are prevented. Step 214 follows thereafter.

In a preferred embodiment, it is provided for asymmetric operation of the engine (that is, for operation of the engine with two different modes of operation or with two different desired torque values), to alternately change the particular operating state of the cylinder banks of the engine. That is, in a predetermined time raster (for example, for operation of the one cylinder bank in homogeneous operation and the other cylinder bank in stratified operation), it is provided to switch over the banks in such a manner that the first bank is operated in stratified operation and the second bank is operated in homogeneous operation (toggling).

In the described embodiment, two cylindrical banks are provided which have two electrically actuable throttle flaps which are controllable independently of each other. In addition to such a solution, the solution according to the invention can also be applied to engines having several cylinder banks and several (corresponding to the number of cylinder banks) throttle flaps, which are controllable independently of each other, especially also to engines having individual throttle flaps for each cylinder.

In another embodiment of the invention, the cylinder banks are switched over simultaneously at least in specific operating situations, for example, for high torque requests and high power requests. In this way, an improvement of the dynamic performance is achieved. Referred to the program in FIG. 3, this means that the steps 208 and 212 and, if required, the steps 220 and 224 are omitted in the above-mentioned operating state and the steps 206 and 210 are combined as are the steps 218 and 222.

In general, one cylinder bank or cylinder group is switched over when the first cylinder is operated in the new operating mode. "Simultaneously" is here therefore understood to be the condition that the switchover at one bank or group is initiated within a time span, which lies between the switchover signal and the completed injection in the first cylinder in the new operating mode at the bank or group at which the operating mode had previously been changed. Correspondingly, "sequentially" means the initiation of the switchover at one bank outside of this time span which is pregiven by the first switchover bank or group.

In another embodiment, a corresponding procedure is applied to an internal combustion engine having only one controllable throttle flap wherein one cylinder group is operated homogeneously and the other stratified. In this case, the air charge is increased by the throttle flap so that a larger part of the desired torque value is obtained via homogeneous control of a cylinder group having stoichiometric or lean mixture composition while a smaller portion of the desired torque is obtained via stratified operation of the other cylinder group.

What is claimed is:

1. A method for operating an internal combustion engine having gasoline direct injection and having at least first and second cylinder groups, the method comprising the steps of:

controlling said first and second cylinder groups, respectively, in dependence upon a pregiven desired torque value and a pregiven operating mode;

providing at least first and second modes of said engine and injecting fuel in both of said operating modes;

in at least one operating state of said engine, operating said first cylinder group in said first operating mode (BAdes1) and operating said second cylinder group in said second operating mode (BAdes2); and, inputting a changing desired torque value (Mides1, Mides2) for each of said cylinder groups and adjusting the torque of the corresponding cylinder group in dependence upon the desired torque value (Mides1, Mides2) thereof.

2. The method of claim 1, wherein the desired torques are equal for both cylinder groups.

3. The method of claim 1, wherein a total desired torque value (Mides) is pregiven, one of the cylinder groups is controlled with a first part (Mides1) of this total desired torque, another one of the cylinder groups is controlled by a second part (Mides2) of the desired torque and the two components of the desired torque yield the total desired torque.

4. The method of claim 1, wherein one operating state is the operating state of increased power request and/or is the operating state during which a storage catalytic converter is cleared.

5. The method of claim 1, wherein a switchover of the operating modes of the individual cylinder groups takes place sequentially.

6. The method of claim 1, wherein, in dependence upon the operating state, a wanted operating mode (BAdes) is pregiven which is realized by a control of the individual cylinder groups when this realization does not contradict other inputs.

7. The method of claim 1, wherein, for each cylinder group, an electrically actuable throttle flap is provided, with the control of which the operating mode switchover is undertaken.

8. The method of claim 1, wherein only one electrically controllable throttle flap is provided for all cylinder groups; this throttle flap is so controlled in operation with different modes of operation in the sense of an air charge increased relative to the throttled operation so that one portion of the cylinders can be operated in the first operating mode and another portion can be operated in the second dethrottled operating mode.

9. The method of claim 1, wherein the switchover of the operating modes of the individual cylinder groups takes place simultaneously at least in an operating mode having high power request or torque request.

10. An arrangement for operating an internal combustion engine having gasoline direct injection and having at least first and second cylinder groups, the arrangement comprising:

a control apparatus for controlling said first and second cylinder groups, respectively, in dependence upon a pregiven desired torque value and a pregiven operating mode; and, said control apparatus including: means for providing at least first and second modes of said engine and injecting fuel in both of said operating modes; means for operating said first cylinder group in said first operating mode (BAdes1) and operating said second cylinder group in said second operating mode (BAdes2) in at least one operating state of said engine; and, means for inputting a changing desired torque value (Mides1, Mides2) for each of said cylinder groups and adjusting the torque of the corresponding cylinder group in dependence upon the desired torque value (Mides1, Mides2) thereof.

* * * * *